US009797674B2

(12) United States Patent
Barber

(10) Patent No.: US 9,797,674 B2
(45) **Date of Patent: *Oct. 24, 2017**

(54) CROSSBOW DE-TENSIONING APPARATUS

(71) Applicant: The Outdoor Group, LLC, West Henrietta, NY (US)

(72) Inventor: Timothy R. Barber, Honesdale, PA (US)

(73) Assignee: CAMX Outdoors LLC, West Henrietta, NY (US)

( * ) Notice: Subject to any disclaimer, the term of this patent is extended or adjusted under 35 U.S.C. 154(b) by 7 days.

This patent is subject to a terminal disclaimer.

(21) Appl. No.: 15/072,691

(22) Filed: Mar. 17, 2016

(65) Prior Publication Data

US 2016/0195357 A1 Jul. 7, 2016

Related U.S. Application Data

(63) Continuation of application No. 14/305,357, filed on Jun. 16, 2014, now Pat. No. 9,303,944, which is a continuation-in-part of application No. 13/325,953, filed on Dec. 14, 2011, now Pat. No. 8,752,535.

(60) Provisional application No. 61/494,500, filed on Jun. 8, 2011, provisional application No. 61/440,563, filed on Feb. 8, 2011, provisional application No. 61/422,770, filed on Dec. 14, 2010.

(51) Int. Cl.
*F41B 5/12* (2006.01)
*F41B 5/14* (2006.01)

(52) U.S. Cl.
CPC ..... *F41B 5/1449* (2013.01); *F41B 5/12* (2013.01); *F41B 5/123* (2013.01)

(58) Field of Classification Search
CPC ..... F41B 5/12; F41B 5/14
See application file for complete search history.

(56) References Cited

U.S. PATENT DOCUMENTS

| | | | | |
|---|---|---|---|---|
| 3,561,419 | A | 2/1971 | Cucuzza, Sr. | |
| 4,261,321 | A | 4/1981 | Nishioka | |
| 4,605,223 | A | 8/1986 | Rainville | |
| 4,623,145 | A | 11/1986 | Paraskevakos | |
| 4,708,341 | A | 11/1987 | Paraskevakos | |
| 4,911,364 | A | 3/1990 | Irie | |
| 5,002,035 | A | 3/1991 | Brooks | |
| 5,143,043 | A | 9/1992 | Brelsford | |
| 5,297,533 | A | 3/1994 | Cook | |
| 5,445,139 | A | 8/1995 | Bybee | |
| 5,592,928 | A | 1/1997 | Frasier | |
| 5,598,829 | A * | 2/1997 | Bednar | F41A 17/28 124/25 |

(Continued)

OTHER PUBLICATIONS

Archery Exchange, Vibracheck—Safedraw Shooting System, Feb. 1, 2002, retrieved from the internet: http://www.archeryexchange.com/shopexd.asp?id=225, 4 pages.

(Continued)

*Primary Examiner* — John Ricci
(74) *Attorney, Agent, or Firm* — Barclay Damon LLP

(57) ABSTRACT

A crossbow de-tensioning apparatus includes, in an embodiment, a de-tensioning device configured to be coupled to a crossbow. The de-tensioning apparatus also includes at least one hook operatively coupled to the de-tensioning device. The at least one hook is configured to be hooked onto a bowstring of the crossbow.

22 Claims, 6 Drawing Sheets

(56) References Cited

U.S. PATENT DOCUMENTS

| | | | |
|---|---|---|---|
| 5,749,348 | A | 5/1998 | Oviedo-Reyes |
| 6,161,532 | A | 12/2000 | Goff et al. |
| 6,273,078 | B1 | 8/2001 | Schwesinger |
| 6,499,478 | B1 | 12/2002 | Perez |
| 6,736,123 | B1 | 5/2004 | Summers et al. |
| 6,799,566 | B1 | 10/2004 | Malucelli |
| 6,874,491 | B2 | 4/2005 | Bednar |
| 7,017,568 | B1 | 3/2006 | Smith |
| 7,216,643 | B2 | 5/2007 | Pellerite |
| 8,375,928 | B1 | 2/2013 | Bednar et al. |
| 8,578,916 | B2 | 11/2013 | Maleski et al. |
| 8,752,535 | B2 | 6/2014 | Barber et al. |
| 2004/0014010 | A1 | 1/2004 | Swensen et al. |
| 2014/0261358 | A1 | 9/2014 | Pulkrabek et al. |
| 2015/0013657 | A1 | 1/2015 | Kempf |

OTHER PUBLICATIONS

About Sports, "How to Decock/Uncock a Crossbow Using a Rope", Sep. 23, 2009, retrieved from the internet <hunting.about.com/od/arch/ss/how_to__cock__a__crossbow.htm>, 11 pages.

* cited by examiner

CROSSBOW DE-TENSIONING APPARATUS

CROSS-REFERENCE TO RELATED APPLICATIONS

This application is a continuation application of and claims the benefit and priority of, U.S. patent application Ser. No. 14/305,357, filed on Jun. 16, 2014, which is a continuation-in-part of U.S. patent application Ser. No. 13/325,953, filed on Dec. 14, 2011, now U.S. Pat. No. 8,752,535, which claims priority to: (i) U.S. Provisional Patent Application No. 61/494,500, filed on Jun. 8, 2011; (ii) U.S. Provisional Patent Application No. 61/440,563, filed on Feb. 8, 2011; and (iii) U.S. Provisional Patent Application No. 61/422,770, filed on Dec. 14, 2010. The entire contents of the foregoing applications are hereby incorporated by reference.

FIELD

The present disclosure relates to devices for decocking a cocked crossbow. More particularly, the disclosure relates to a crossbow having an integrally incorporated device for facilitating decocking of the crossbow without dry firing or firing a projectile.

BACKGROUND

The disclosure relates to a crossbow that integrates a device uncocking of the crossbow, also called decocking of a crossbow. More directly, the disclosure relates to uncocking or decocking a ready-to-fire crossbow without dry firing or firing a projectile known in the art as an arrow or sometimes referred to as a bolt, a medieval term for a short arrow.

Crossbows are generally cocked by a manually drawing the bowstring by hand to a loaded position or by using a drawstring or a winch-type cranking mechanism that draws the bowstring that is attached to the bowlimbs of the crossbow into a loaded position where the string is locked by a trigger mechanism. This load also known as potential elastic energy is measured in the art today by draw pounds. Most modern crossbows bear draw weights from 100-200 pounds. Once the release mechanism is actuated by the trigger, the bowstring is released and the potential elastic energy transitions to potential kinetic energy.

Drawing a crossbow string to a cocked position is accomplished in several ways. Most commonly today, crossbows are outfitted with a steel or aluminum stirrup mounted on the front of the crossbow. The stirrup is used to hold the front of the bow down with one foot, while the bowstring is drawn using a drawstring typically comprised of braided nylon or polypropylene rope attached to hooks on each end with a "T" or "D" handle that traverses on the drawstring. By attaching the hooks to the bowstring, then stepping in the stirrup and pulling on the handles in an upward motion, the bowstring of the crossbow is drawn into a loaded cocked position.

Another method of cocking the crossbow is a cranktype mechanism. This mechanism uses a gear reduction manual cranking means as the method to draw the bowstring into the loaded position. Efficient as a cocking device, it is generally not recommended to attempt to uncock or decock the crossbow using this device as it can and may cause serious injury to the operator and potentially damage to the crossbow.

Once the bow is cocked, this stored load of elastic energy can be released transitioning to potential kinetic energy by the actuation of a trigger mechanism releasing the bowstring, which then propels a projectile known as an arrow although sometimes referred to as a bolt, with tremendous thrust and speed, away from the crossbow. This is also the typical manner of uncocking, decocking or unloading a cocked or loaded crossbow, which can result in losing, damaging or destroying the deployed arrow. In some jurisdictions it is illegal to exit a hunting area with a loaded weapon, such as a crossbow, requiring one to discharge the crossbow, propelling the arrow prior to exiting the field, a potentially dangerous and inefficient manner of unloading.

Accordingly, there is a need for a decocking structure that can be incorporated into a crossbow structure and operable to decock the crossbow without dry firing or tiring a projectile.

SUMMARY

The disclosure provides a crossbow having an integrated decocking system.

In one aspect, a crossbow according to the disclosure includes a stock having a static portion and a movable portion, a bow having a bowstring, a bowstring catch, a resistance system, and a bowstring coupling system coupled to the resistance system.

The resistance system includes a fluid containing cylinder having a movable piston and located within the static portion of the stock, and a shaft extending from the piston and having a terminal end. The piston is movable between a first position and a second position, and the cylinder includes an orifice having a size and extending through the piston to enable fluid to travel from one side of the piston to the other and to control the movement of the piston to a desired rate.

The bowstring coupling system includes a cable having a first portion releasably securable to the bowstring and a second portion of the cable interfacing with a location on the shaft of the resistance system.

The crossbow is decocked from a cocked state by releasably securing the cable to the bowstring, applying pressure to the piston by pulling on the shaft to extend the shaft, then actuating the catch to release the bowstring, wherein the released bowstring applies pressure to retract the shaft, which pressure is resisted by the resistance system, with the size of the orifice controlling the retraction of the shaft and thereby controlling travel of the bowstring and decocking of the crossbow.

In another aspect, a crossbow according to the disclosure includes a bow having a bowstring, a bowstring catch, a resistance system operatively associated with the crossbow, and a bowstring coupling system coupled to the resistance system.

The resistance system includes a fluid containing cylinder having a movable piston, the piston being movable between a first position and a second position at a desired rate.

The bowstring coupling system includes a cable having a first portion releasably securable to the bowstring and a second portion of the cable interfacing with the resistance system.

The crossbow is decocked from a cocked state by releasably securing the cable to the bowstring, applying pressure to the piston, then actuating the catch to release the bowstring, wherein the released bowstring applies pressure, which pressure is resisted by the resistance system to control travel of the bowstring and decocking of the crossbow.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
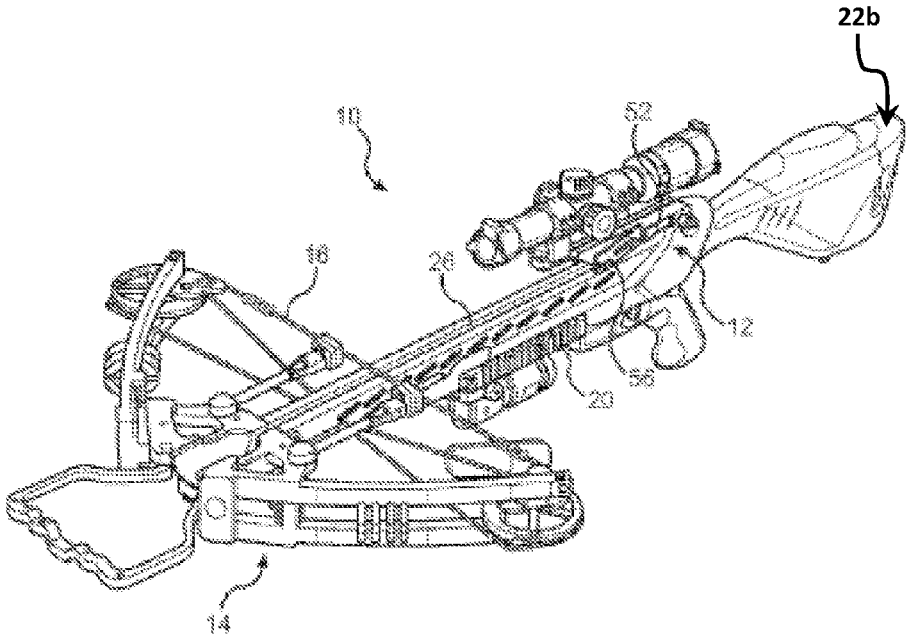
FIGS. 1-3 show a crossbow according to the disclosure having an integrated decocking system.
Figure 2:
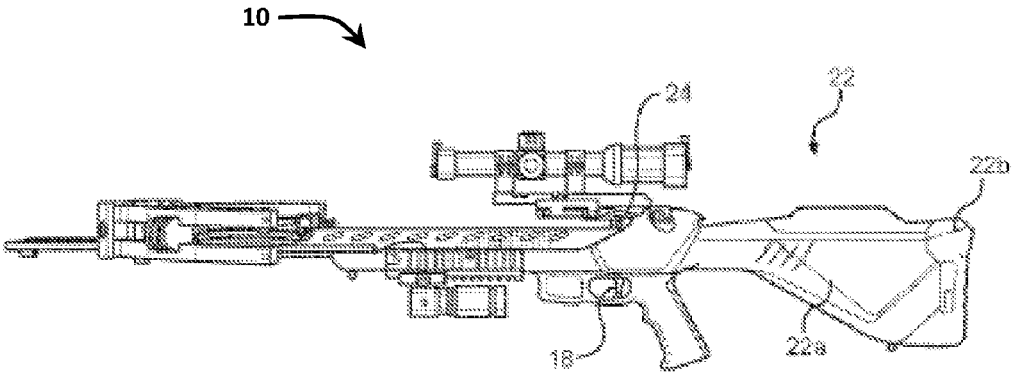
Figure 3:
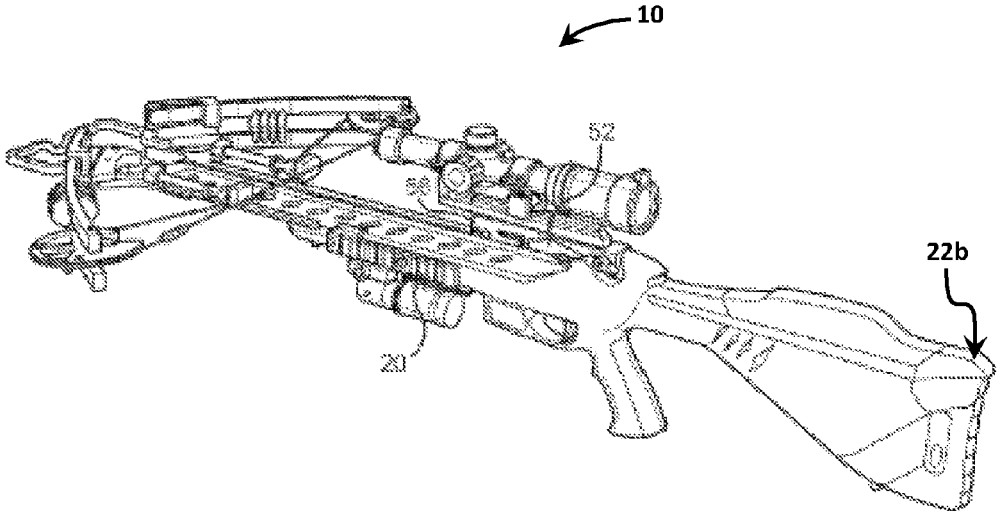

With reference to the drawings, there is shown a crossbow 10 having a decocking system 12 integrated into the crossbow 10. The decocking system 12 is operable to enable decocking of the crossbow 10 without The crossbow 10 is shown in a relaxed state in FIGS. 1-3. FIGS. 4-7 show the crossbow 10 in a tensioned state in which the crossbow is typically loaded with a bolt or arrow, with FIGS. 4-7 showing activation of the decocking system 12 so that the crossbow 10 may be decocked without dry firing thereof and without firing of a bolt or arrow. FIGS. 8-12 shows operation of the decocking system 12 to decock the crossbow 10.

The crossbow 10 includes a bow 14, bowstring 16, trigger 18, a stock including a forestock 20 and a butt stock 22 having a static portion 22*a* and a movable portion 22*b*, a catch 24, and arrow groove 26. An arrow or bolt is oriented in the groove 26 so that a nock of the bolt is maintained in contact with a central portion of the bowstring 16 retained by the catch 24. To fire the crossbow 10, a user activates the trigger 18, which manipulates the catch to release the bowstring and thereby fire the bolt, and decock the crossbow.

The decocking system 12 includes a resistance system 30 and a bowstring coupling system 32. The resistance system 30 supplies a resistance force to enable controlled return of the crossbow from the drawn state to the relaxed state. In this regard, the bowstring coupling system 32 couples the bowstring 16 to the resistance system 30 so as to enable the resistance system 30 to interact with the bowstring 16.

The resistance system 30 may include a double-acting fluid cylinder 40. In this regard, the term "fluid" will be understood to encompass both liquid and gas cylinders. A preferred fluid cylinder is a pneumatic cylinder having an internal piston from which extends in one direction a shaft 42. A through-bored orifice extends through the piston to permit gas/air for other fluid) to travel from one side of the piston to the other side, it being understood that the size of the orifice controls passage of fluid and, hence, travel of the piston and, hence the shaft 42, connected to the piston. A desired dimension of the orifice is 1/16 inches. The cylinder 40 includes an endcap 40*a* at each end of the cylinder 40, with the shaft 42 extending outwardly through one of the endcaps 40*a*. The cylinder also includes a pair of ports located at opposite ends of the cylinder 40 for introduction of fluid (air for a pneumatic cylinder) into the cylinder 40. Double acting pneumatic cylinders utilize air pressure to control movement in both the extending and retracting strokes, i.e., extension of the shaft out of the cylinder and retraction into the cylinder. In this regard, as will be explained more filly below, manual pressure is provided by pulling on the movable portion 22*b* of the butt stock 22 coupled to the end of the shaft 42 to extend the shaft 42 and, when the bowstring 16 is released, the bowstring 16 applies pressure to retract the shaft 42, with the size of the orifice controlling the retraction of the shaft 42 and thereby controlling de-tensioning of the crossbow 10. The cylinder 40 may be otherwise integrated into the crossbow 10 and need not necessarily be located within the butt stock 20.

The coupling system 32 couples the resistance system 30 to the bowstring 16 and includes a pair of pulleys 50 rotatably located on the shaft 42 interior of the movable portion 22*b* of the butt stock 22, a pair of cable cords or decocking cables 52, one trained around each of the pulleys 50. One free end of each of the cables 52 is secured to a spring-loaded cable reel 54, and the other free end of each of the cables 52 is attached to a bow string hook 56 or other connecting structure for releasably connecting the end of the cables 52 to the bowstring 16. Thus, each of the cables 52 is connectable to the bowstring 16. While a single cable could be utilized, it is preferred to utilize at least two for redundancy. Each of the bow string hooks 56 is attached to one side of a cradle 58 that is releasably positionable on the crossbow 10 adjacent the arrow groove 26. The cradle 58 is nominally positioned and maintained out of the way of the arrow groove 26. However, when desired to activate the decocking system 12, the cradle 58 is positioned within the arrow groove 26 so that the hooks 56 engage the bowstring 16. In addition, the cradle 58 is configured to include a rearward surface that simulates the shape of a bolt so as to cooperate with safety features of the bow 10 that serve to disengage the trigger 18 when a bolt is not loaded and prohibit dry firing of the bow 10. The cable reel 54 serves to retract the other ends of the cables 52 to maintain them taught relative to the static portion 22*a* of the butt stock 22. An additional pulley 60 is desirably located within the interior of the static portion 22*a* of the butt stock 22 for separating the cables 52 to avoid tangling, one of the cables 52 being routed over the pulley 60 and the other over the pulley 60. Additional pulleys and the like may be used to reduce friction and the like for routing the cables 52 in and out and within the butt stock 22.

Figure 4:
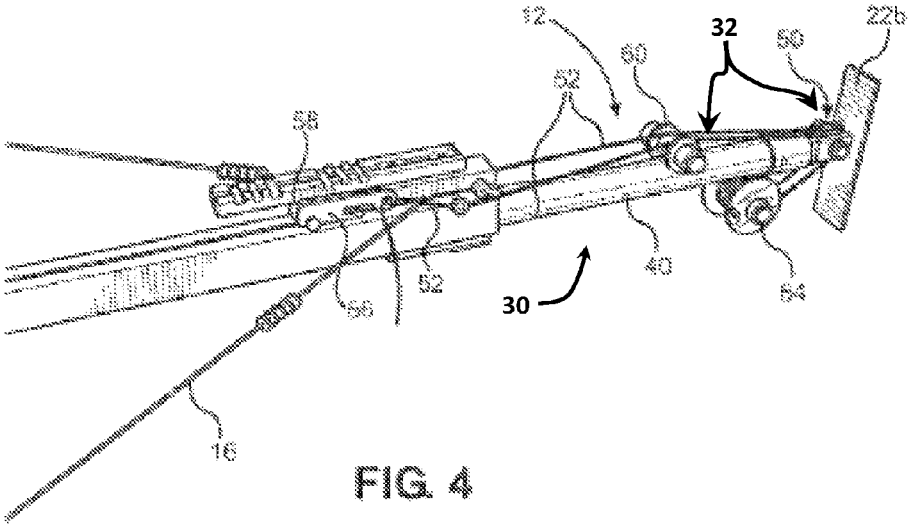
FIGS. 4-7 depict activation of the decocking system so that the crossbow may be decocked.
Figure 5:
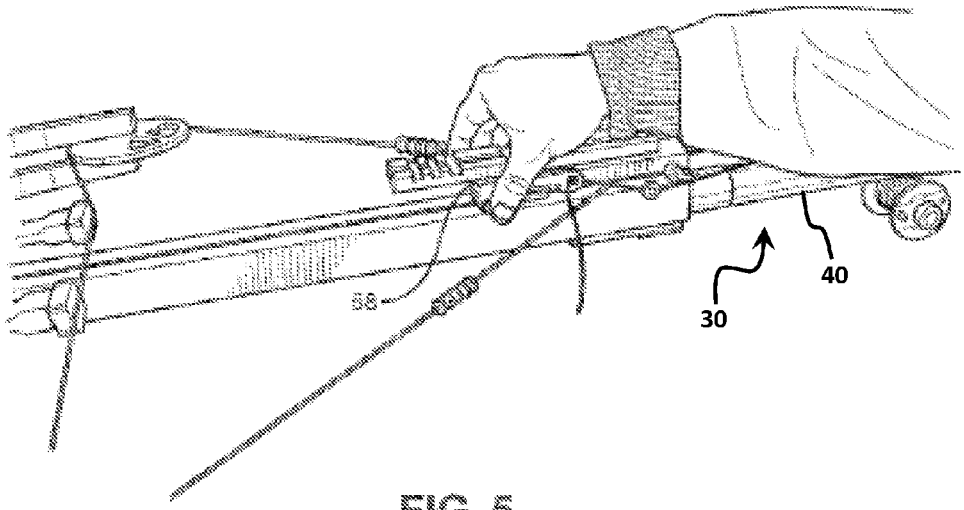
Figure 6:
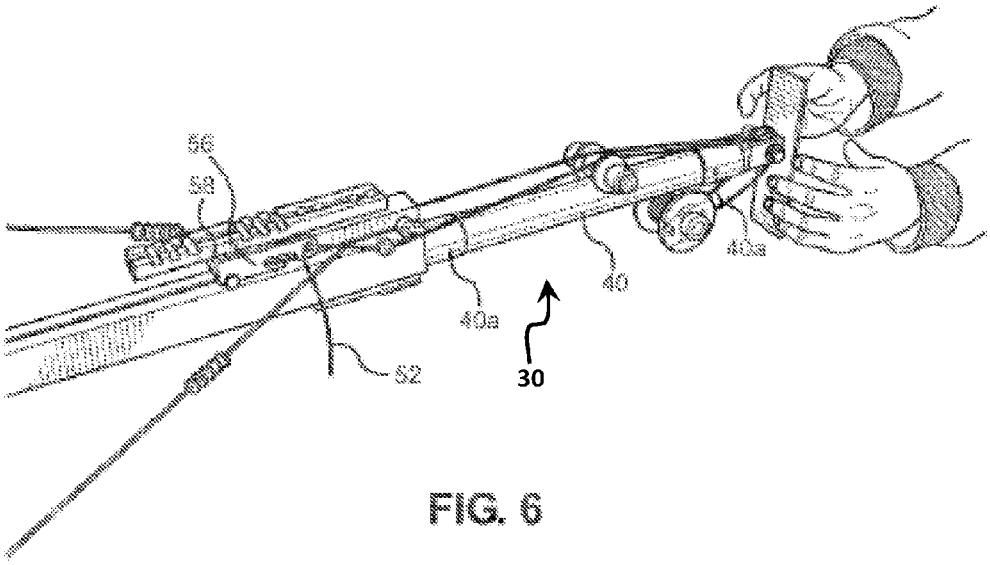
Figure 7:
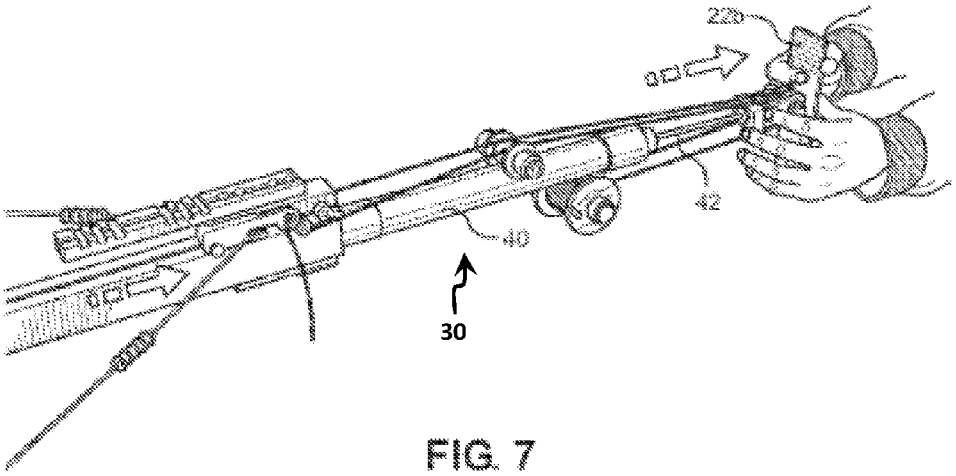
Figure 8:
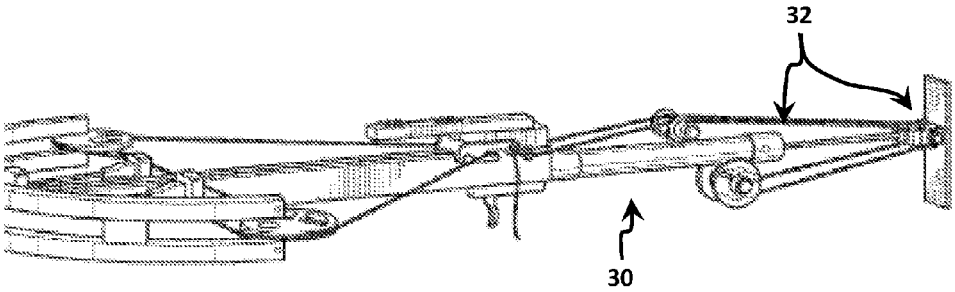
FIGS. 8-12 operation of the decocking system to decock the crossbow.
Figure 9:
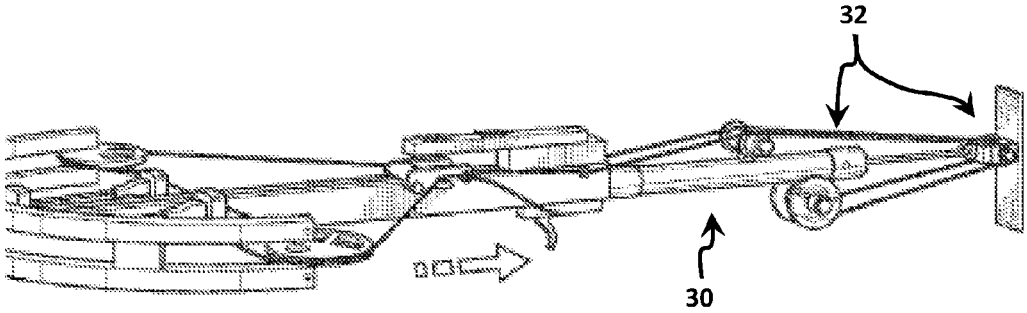
Figure 10:
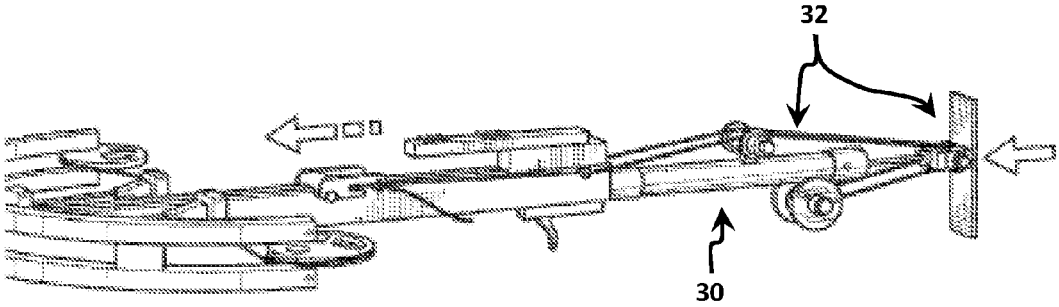
Figure 11:
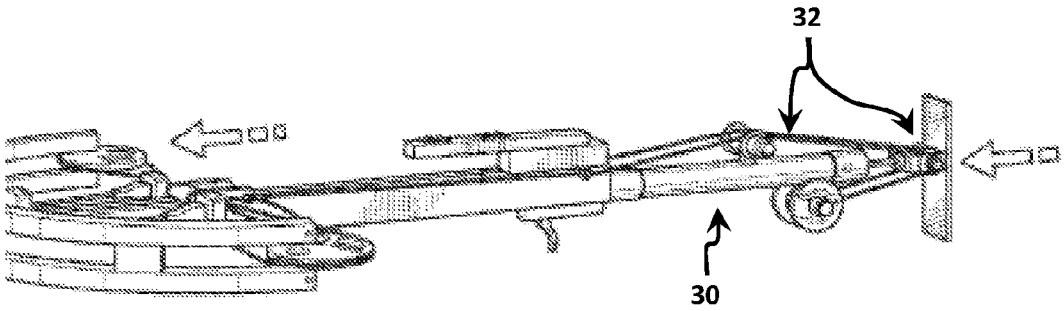
Figure 12:
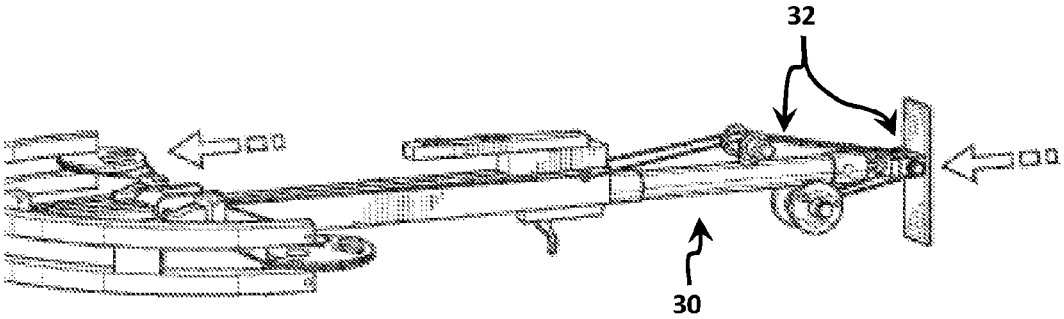

To utilize the decocking system 12 with a cocked crossbow, the bolt or arrow is removed and the system 12 is arranged to fill the cylinder 40 with fluid and the cradle 58 is located in the arrow groove 26 to position the hooks 56 to engage with the bowstring 16. This is depicted in the sequence of FIGS. 4-7. For example, as shown in FIGS. 4 and 5, the cradle 58 is moved from its inactive position out of the way of the groove 26 and positioned on the groove 26 with the hooks 56 located adjacent the bowstring 16. Next, as shown in FIGS. 6 and 7, the movable portion 22*b* of the butt stock 22 is pulled rearward which serves to extend the shaft 42 and thereby draw fluid (air) into the piston 40. This also serves to tension the cables 52 and pull the hooks 56 into engagement with the bowstring 16.

To decock the bow 10, as depicted in FIGS. 8-12, the trigger 16 is actuated to release the bowstring from the catch 24. The force supplied by the bow 14 via the bowstring 16 acts via the cables 52 to urge the piston and the shaft 42 to the retracted position in the cylinder 40. This movement of the piston forces fluid through the orifice thereof, moving the fluid from the front of the piston to behind the piston within the cylinder 40. The small orifice size regulates the fluid volume at a specific flow rate, permitting the piston to move through the cylinder 40 at a slow regulated pace, thus allowing the crossbow to decock under a controlled state. By doing so, the bowstring 16 which is attached to the bow, moves slowly from a tensioned position to a neutral uncocked position.

Accordingly, it will be appreciated that crossbows according to the disclosure include an integrated decocking system that enables a bowstring of the crossbow to be positioned from a cocked, ready-to-fire position, to an uncocked and at-rest position without firing a projectile or without dry firing the crossbow.

The foregoing description of preferred embodiments for this disclosure has been presented for purposes of illustration and description, it is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The following is claimed:

1. A crossbow de-tensioning apparatus comprising:

a container configured to receive fluid, the container also configured to be coupled to a crossbow;

a piston movably positioned within the container;

a shaft coupled to the piston;

a hook operatively coupled to the shaft, the hook configured to be hooked onto a bowstring of the crossbow; and a member configured to cooperate with a safety element of the crossbow, wherein, when the crossbow is cocked, the container is coupled to the crossbow, the hook is hooked onto the bowstring, and the member is coupled to the crossbow:

the member is configured to cooperate with the safety element of the crossbow to enable firing action of a trigger of the crossbow;

the hook applies a resistance force to the bowstring after the firing action of the trigger occurs; and the resistance force is based, at least in part, on the fluid in the container.

2. The crossbow de-tensioning apparatus of claim 1, wherein the piston defines a hole.

3. The crossbow de-tensioning apparatus of claim 2, wherein the container defines at least one port.

4. The crossbow de-tensioning apparatus of claim 1, wherein the fluid comprises air.

5. The crossbow de-tensioning apparatus of claim 1, wherein the piston defines a hole enabling the fluid in the container to generate resistance during forward and rearward movements of the piston relative to the container.

6. The crossbow de-tensioning apparatus of claim 1, wherein the crossbow comprises a butt stock defining a cavity, the container configured to be inserted in the cavity.

7. The crossbow de-tensioning apparatus of claim 1 comprising a cradle, wherein the hook and the member are portions of the cradle.

8. The crossbow de-tensioning apparatus of claim 1 comprising at least one cable configured to couple the hook to the shaft.

9. A crossbow device comprising the crossbow de-tensioning apparatus of claim 1, wherein:

the crossbow device is positionable to be aimed in a forward direction;

the crossbow device comprises a bow, a fore stock and a butt stock;

the butt stock defines a cavity which at least partially receives the container;

the butt stock comprises a movable portion configured to be moved relative to the fore stock in a rearward direction; and the movement of the movable portion causes the piston to move.

10. The crossbow de-tensioning apparatus of claim 1, wherein:

a portion of the bowstring is configured to be moved along a shooting axis between: (a) a drawn position when the crossbow is cocked; and (b) an undrawn position after the crossbow is fired; and the hook is configured to move along the shooting axis while the portion of the bowstring moves from the drawn position to the undrawn position.

11. A crossbow de-tensioning apparatus comprising:

a de-tensioning device configured to be coupled to a crossbow; and at least one hook operatively coupled to the de-tensioning device, the at least one hook configured to be hooked onto a bowstring of the crossbow, wherein the de-tensioning apparatus is configured to cooperate with the crossbow to apply a de-tensioning force to the bowstring in response to a firing action of a trigger of the crossbow, wherein the crossbow de-tensioning apparatus further comprises a member configured to cooperate with a safety feature of the crossbow to enable the firing action of the trigger.

12. The crossbow de-tensioning apparatus of claim 11, wherein the de-tensioning device comprises:

a container configured to receive fluid;

a piston movably positioned within the container; and a shaft coupled to the piston, wherein the shaft is operatively coupled to the at least one hook.

13. The crossbow de-tensioning apparatus of claim 12, wherein the piston defines a hole enabling the de-tensioning device to generate resistance during forward and rearward movements of the piston relative to the container.

14. A crossbow device comprising the crossbow de-tensioning apparatus of claim 12, wherein:

the crossbow device comprises a bow, a fore stock and a butt stock;

the butt stock defines a cavity which at least partially receives the container;

the butt stock comprises a movable portion configured to slide between forward and rearward positions relative to the fore stock; and the sliding of the movable portion causes the piston to move.

15. The crossbow de-tensioning apparatus of claim 11 comprising a cradle, wherein the at least one hook is a portion of the cradle.

16. The crossbow de-tensioning apparatus of claim 11 comprising:

a second member configured to move relative to the crossbow when the crossbow de-tensioning apparatus is coupled to the crossbow; and at least one cable which couples the at least one hook to the second member.

17. A crossbow de-tensioning apparatus comprising:

a de-tensioning device structured to be coupled to a crossbow configured to be aimed in a forward direction toward a target, the de-tensioning device comprising a cylinder-piston assembly structured to compress fluid; and at least one hook operatively coupled to the de-tensioning device, the at least one hook structured to be removably hooked onto a bowstring of the crossbow so as to pull on the bowstring in a rearward direction.

18. The crossbow de-tensioning apparatus of claim 17, wherein:

the cylinder-piston assembly is positioned rearward of the bowstring; and while the de-tensioning device is coupled to the crossbow, the at least one hook is structured to be removed from the bowstring to enable the bowstring to launch a projectile in the forward direction.

19. The crossbow de-tensioning apparatus of claim 17 comprising a member configured to cooperate with a safety feature of the crossbow to enable a firing action of a trigger of the crossbow, wherein the member comprises one of: (a) a portion of the at least one hook; or (b) another portion of the crossbow de-tensioning apparatus.

20. The crossbow de-tensioning apparatus of claim 19, wherein, when the de-tensioning device is coupled to the crossbow, the de-tensioning device and the at least one hook are structured to cooperate with the crossbow to:

enable a user to retract the bowstring until the bowstring is held by a catch of the crossbow;

enable the user to hook the at least one hook onto the bowstring;

enable the user to couple the member to the crossbow to enable firing action of the trigger of the crossbow;

enable the user to pull the trigger, causing the trigger to move relative to a fore stock of the crossbow; and gradually decrease tension in the bowstring in response to the movement of the trigger.

21. The crossbow de-tensioning apparatus of claim 17, comprising a member configured to cooperate with a safety feature of the crossbow to enable a firing action of a trigger of the crossbow, wherein the member is structured to be at least partially inserted into a channel of the crossbow, the channel configured to at least partially receive a projectile.

22. The crossbow de-tensioning apparatus of claim 17, wherein:

a portion of the bowstring is configured to be moved along a shooting axis between: (a) a drawn position when the crossbow is cocked; and (b) an undrawn position after the crossbow is fired; and the hook is configured to move along the shooting axis while the portion of the bowstring moves from the drawn position to the undrawn position.

* * * * *